US011691438B2

(12) United States Patent
Kuronuma

(10) Patent No.: US 11,691,438 B2
(45) Date of Patent: Jul. 4, 2023

(54) PRINTING APPARATUS, PRINTING SYSTEM, PRINTING CONTROL METHOD, AND RECORDING MEDIUM

(71) Applicant: CASIO COMPUTER CO., LTD., Tokyo (JP)

(72) Inventor: Hirotaka Kuronuma, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 134 days.

(21) Appl. No.: 17/221,022

(22) Filed: Apr. 2, 2021

(65) Prior Publication Data

US 2021/0315359 A1 Oct. 14, 2021

(30) Foreign Application Priority Data

Apr. 9, 2020 (JP) ..... 2020-070341

(51) Int. Cl.
*B41J 3/407* (2006.01)
*B41J 3/36* (2006.01)

(52) U.S. Cl.
CPC ..... *B41J 3/407* (2013.01); *B41J 3/36* (2013.01)

(58) Field of Classification Search
CPC ..... B41J 3/407; B41J 3/36; B41J 11/0015; A45D 2029/005
See application file for complete search history.

(56) References Cited

U.S. PATENT DOCUMENTS

| | | | | |
|---|---|---|---|---|
| 6,286,517 | B1 | 9/2001 | Weber et al. | |
| 9,943,154 | B2 | 4/2018 | Teshima et al. | |
| 2017/0079402 | A1* | 3/2017 | Miyamoto | G06K 9/6215 |
| 2017/0215549 | A1* | 8/2017 | Teshima | A45D 34/04 |

FOREIGN PATENT DOCUMENTS

| | | | |
|---|---|---|---|
| CN | 107048667 | A | 8/2017 |
| JP | 2003534083 | A | 11/2003 |

OTHER PUBLICATIONS

Chinese Office Action dated Jun. 6, 2022 (and English translation thereof) issued in counterpart Chinese Application No. 202110364899.5.

* cited by examiner

*Primary Examiner* — Scott A Richmond
(74) *Attorney, Agent, or Firm* — Holtz, Holtz & Volek PC

(57) ABSTRACT

A printing apparatus that performs printing on a nail to which a base is applied determines an order of applying a base to the nails of a plurality of fingers by a practitioner based on practitioner information about the practitioner who applies the base to the nail, sets, based on the base application order for the nails, the print order for the nails of the plurality of fingers, and performs, based on this print order, printing on the nails of the plurality of fingers, to which the base was applied.

16 Claims, 7 Drawing Sheets

TBLa

FIG. 7A

| | LEFT HAND | | | | | RIGHT HAND | | | | |
|---|---|---|---|---|---|---|---|---|---|---|
| | LITTLE FINGER | RING FINGER | MIDDLE FINGER | INDEX FINGER | THUMB | THUMB | INDEX FINGER | MIDDLE FINGER | RING FINGER | LITTLE FINGER |
| ANOTHER PERSON (RIGHT-HANDED) | 10 | 9 | 8 | 7 | 6 | 5 | 4 | 3 | 2 | 1 |
| ANOTHER PERSON (LEFT-HANDED) | 1 | 2 | 3 | 4 | 5 | 6 | 7 | 8 | 9 | 10 |

TBLb

FIG. 7B

| | LEFT HAND | | | | | RIGHT HAND | | | | |
|---|---|---|---|---|---|---|---|---|---|---|
| | LITTLE FINGER | RING FINGER | MIDDLE FINGER | INDEX FINGER | THUMB | THUMB | INDEX FINGER | MIDDLE FINGER | RING FINGER | LITTLE FINGER |
| PERSONAL (RIGHT-HANDED) | 6 | 7 | 8 | 9 | 10 | 5 | 4 | 3 | 2 | 1 |
| PERSONAL (LEFT-HANDED) | 1 | 2 | 3 | 4 | 5 | 10 | 9 | 8 | 7 | 6 |

PRINTING APPARATUS, PRINTING SYSTEM, PRINTING CONTROL METHOD, AND RECORDING MEDIUM

CROSS-REFERENCE TO RELATED APPLICATIONS

This application claims the priority and interests of Japanese Patent Application No. 2020-070341 filed on Apr. 9, 2020. The entire of the specification, claims, and drawings of Japanese Patent Application No. 2020-070341 is incorporated herein by reference.

BACKGROUND

1. Technical Field

The present disclosure relates to a printing apparatus, a printing system, a printing control method, and a recording medium.

2. Related Art

In the related art, a printing apparatus (nail printing apparatus) that prints a nail design on a nail or the like is known (see, for example, JP 2003-534083 A).

SUMMARY

To solve the above problem, an aspect of the printing apparatus of the present disclosure includes:

at least one processor; and a print head, wherein the processor is configured to determine an order of applying a base to nails of a plurality of fingers by a practitioner based on practitioner information about the practitioner who applies a base to a nail, and set, based on the determined order of applying the base to the nails, an order of performing printing on the nails of the plurality of fingers, and the print head is configured to perform, based on the print order, printing on the nails of the plurality of fingers, to which the base was applied.

BRIEF DESCRIPTION OF THE DRAWINGS

FIG. 7A is an example of a table that defines the print order when the practitioner who applies the base is another person different from a person having the nail on which printing is performed;

FIG. 7B is an example of a table that defines the print order when the practitioner who applies the base is a person having a nail to which the base is applied;

DETAILED DESCRIPTION

An embodiment of the printing apparatus, the printing control method, and the program according to the present disclosure will be described with reference to FIGS. 1 to 9.

Although various technically preferable limitations for carrying out the present disclosure are attached to the embodiments described below, the scope of the present disclosure is not limited to the following embodiments and illustrated examples.

Moreover, in the following embodiment, an example is described in which a printing apparatus performs printing on a fingernail of a hand as a printing target, but the printing target of the printing apparatus in the present disclosure is not limited to the fingernail of the hand. For example, the toenail and the like may be the printing target.

Figure 1:
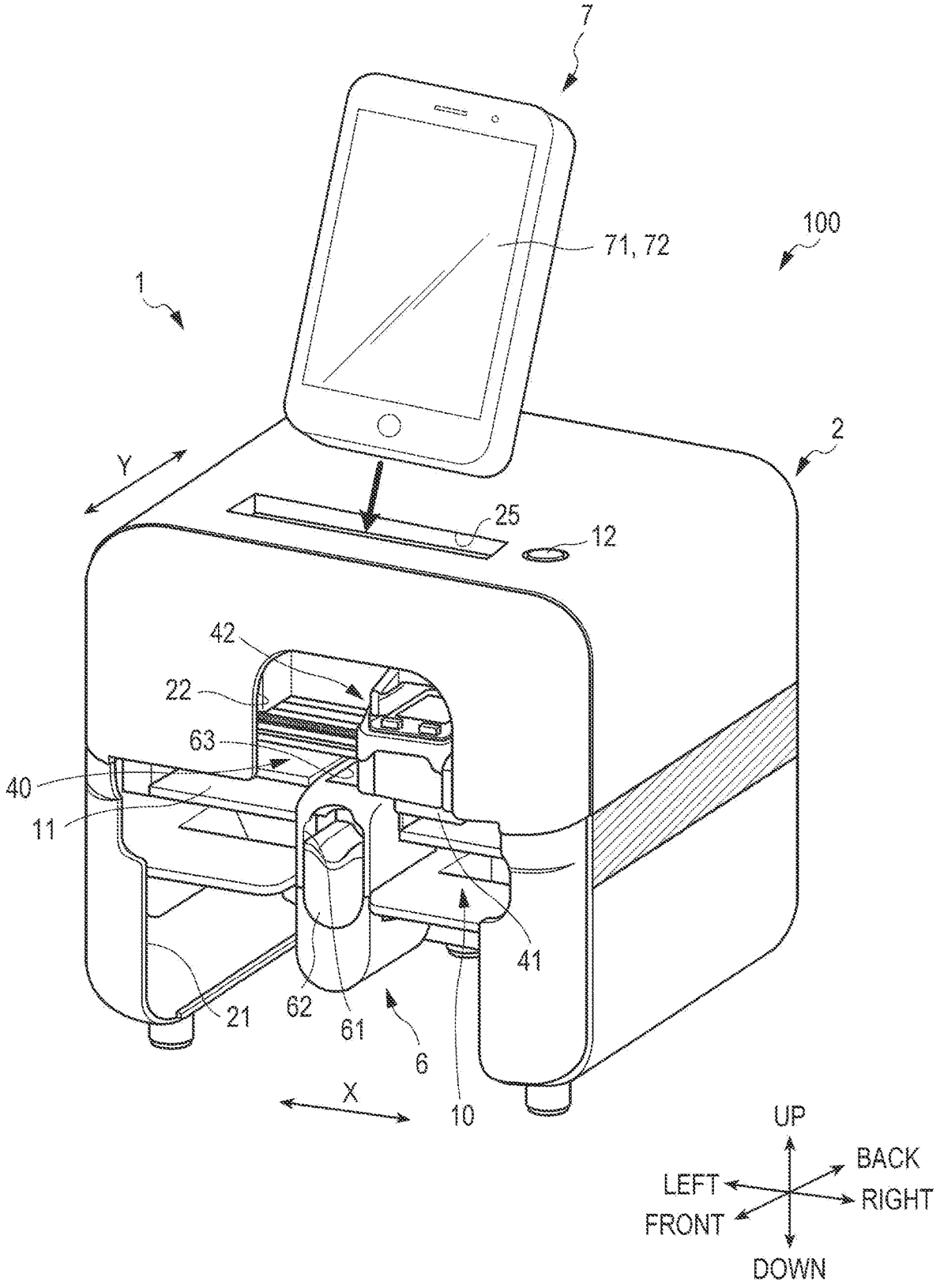
FIG. 1 is a perspective view showing a principal part configuration of a printing apparatus according to the present embodiment.

FIG. 1 is a perspective view showing an external configuration of a principal part of the printing apparatus according to the present embodiment. Further, FIG. 2 is a block diagram showing a control configuration of the printing apparatus of the present embodiment.

In the following embodiments, up/down, left/right, and front/back refer to the directions shown in FIG. 1. The X and Y directions are the directions shown in FIG. 1.

Figure 2:
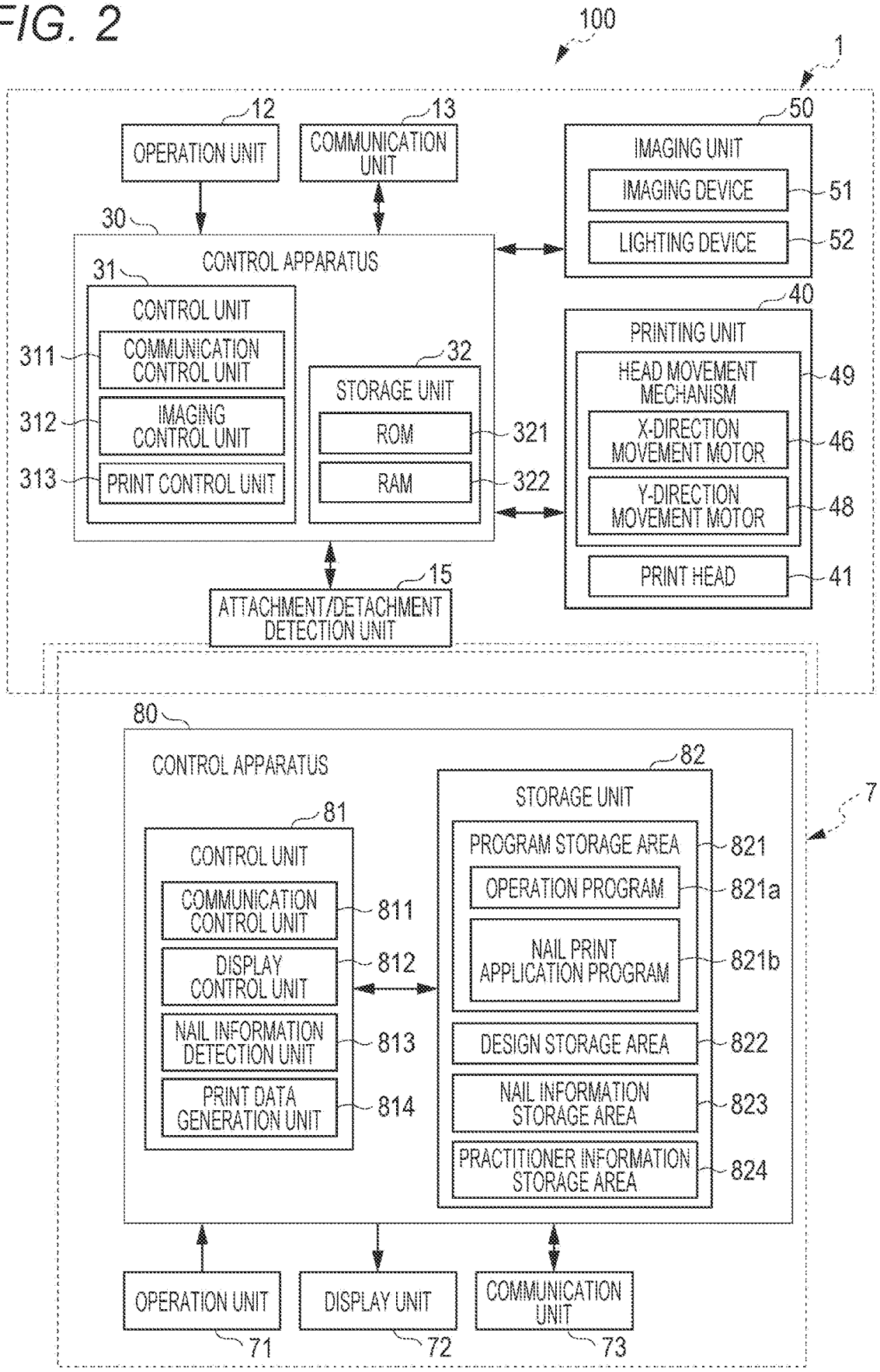
FIG. 2 is a block diagram of a principal part showing a control configuration of a printing apparatus and a terminal device functioning as an operation unit of the printing apparatus in the present embodiment.

As shown in FIGS. 1 and 2, a printing apparatus 100 of the present embodiment includes an apparatus main body 1 and an operation terminal 7 as an operation unit that is configured to be removable from the apparatus main body 1.

The apparatus main body 1 has a housing 2 formed in a substantially box shape.

The housing 2 has an opening 21 formed in the lower portion and in almost the entire surface in the left-right direction (horizontal direction of the apparatus main body 1, left-right direction, X direction in FIG. 1) of the front face (front of the apparatus main body 1, front side in FIG. 1). Further, a cutout 22 is continuously formed at the upper portion of the opening 21 at substantially the central portion of the housing 2 in the left-right direction. The cutout 22 functions as an inlet/exit when attaching and detaching a print head 41, which will be described later, to and from the apparatus.

Although not shown, the housing 2 may include a cover member or the like that covers the opening 21 and the cutout 22. The cover member may be separated from the housing 2, or may be attached to the housing 2 so as to be openable and closable via a hinge or the like.

Further, an operation unit 12 of the apparatus main body 1 is provided on the upper face (top plate) of the housing 2. The operation unit 12 is, for example, an operation button (power switch button) for turning on/off the power of the apparatus main body 1. When the operation unit 12 is operated, an operation signal is output to a control device 30, and the control device 30 performs control according to the operation signal to operate each part of the apparatus main body 1. For example, when the operation unit 12 is a power switch button, the power of the apparatus main body 1 is turned on/off according to the button operation.

Instead of the operation unit 12, each unit of the apparatus main body 1 may operate according to an operation signal input from an operation unit 71 of the operation terminal 7, which will be described later. Further, a configuration may be such that when an attachment/detachment detection unit 15 described later detects that the operation terminal 7 is attached to an attachment port 25, the power of the apparatus main body 1 is turned on to be communicable with the operation terminal 7, and the print start instruction is output to a control unit 31 or the like.

In the present embodiment, as will be described later, the operation terminal 7 can be connected to the apparatus main body 1 to function as an operation unit of the apparatus main body 1.

For example, the attachment port 25 for inserting and mounting the operation terminal 7 that functions as an operation unit is provided on the upper face of the housing 2.

The attachment/detachment detection unit 15 that detects the state of attachment/detachment of the operation terminal 7 is provided inside the attachment port 25. The configuration of the attachment/detachment detection unit 15 is not particularly limited, but is configured by, for example, a push switch that is pressed when the operation terminal 7 is mounted in the attachment port 25. The detection result of the attachment/detachment detection unit 15 is output to the control unit 31 described later, and the state of attachment/detachment of whether the operation terminal 7 is attached to the apparatus main body 1 is acquired by the control unit 31.

In the present embodiment, the operation terminal 7 as an operation unit that is configured to be removable from the apparatus main body 1 is, for example, a dedicated tablet terminal or the like that constitutes the printing apparatus 100.

The operation terminal 7 is not limited to a dedicated tablet terminal or the like, and may be a terminal device such as a smartphone or tablet-type personal computer (hereinafter, referred to as a "PC") owned by a user such as a practitioner P described below or a person to be treated who receives the treatment by the practitioner P (that is, a person having the nail T on which printing is performed by the printing apparatus 100). The operation terminal 7 is not limited to these. As long as the operation terminal 7 can be mounted in the attachment port 25 of the apparatus main body 1, it may be, for example, a terminal device for game.

For the operation terminal 7, the practitioner P who performs the treatment of applying the base described later or the person having the nail T on which printing is performed using the apparatus main body 1 (person to be treated who receives the treatment of the practitioner P) may use a terminal device owned by them as the operation terminal 7, and it is not always necessary that one operation terminal 7 is associated with one apparatus main body 1.

The attachment port 25 may be configured to accept a plurality of types of operation terminals 7 (for example, smartphones, tablet-type terminal devices, and the like). In this way, when a plurality of users use one printing apparatus 100, each user can set and use his/her own smartphone or the like in the apparatus main body 1 when performing printing. In this case, the items set by each person's smartphone or the like can be used as they are for printing, and various settings may be omitted.

When it is assumed that a plurality of types of operation terminals 7 is mounted in this way, the attachment port 25 is formed in a size that can accommodate, among the operation terminals 7 that are expected to be mounted, one having the largest size.

Further, in this case, the attachment/detachment detection unit 15 is provided at a position where the state of attachment/detachment of the operation terminal 7 can be detected regardless of the size and shape of the operation terminal 7 attached to the attachment port 25.

The shape of each part of the housing 2 and the arrangement of each part thereof are not limited to the illustrated examples and can be set as appropriate. For example, the operation unit 12 may be provided on the side face, the back face, or the like of the housing 2, instead of the upper face of the housing 2. Further, the housing 2 may be provided with various other operation buttons as the operation unit 12, or may be provided with various display units, indicators, and the like.

A main body 10 is housed inside the housing 2.

The main body 10 includes a base 11, a finger holding unit 6 attached to the base 11, a printing unit 40, and the like.

The finger holding unit 6 is disposed substantially at the central portion of the base 11 in the left-right direction (X direction) on the front of the apparatus, and is a finger holding unit that holds a finger U having the nail T on which printing is to be performed in the present embodiment in a region suitable for printing.

The finger holding unit 6 has an opening 61 on the front face of the apparatus. A finger fixing member 62 is provided inside the finger holding unit 6. The finger fixing member 62 pushes up and supports from below the finger U inserted through the opening 61, and is made of, for example, a flexible resin or the like.

A window portion 63 is formed on the upper face of the finger holding unit 6 to expose the nail T portion of the finger U inserted through the opening 61 and held by the finger fixing member 62.

The printing unit 40 is a printing unit that performs printing on the nail T on which printing is to be performed according to the print data generated by a print data generation unit 814 (see FIG. 2) described later.

The printing unit 40 includes a print head 41 that performs a printing operation and a head movement mechanism 49 (see FIG. 2) that moves a printing head unit 42 provided with the print head 41.

The print head 41 of the present embodiment has an ink ejection face that faces the nail surface and has a plurality of nozzle openings for ejecting ink (none of which is shown). The print head 41 is an inkjet type inkjet head that performs printing by making ink droplets and directly spraying, from the ink ejection face, the ink onto the surface of the nail of the print target (nail T), on which printing is to be performed. The configuration of the print head 41 is not particularly limited, but for example, it is a cartridge-integrated head in which an ejection mechanism (not shown) provided on an ink ejection face or the like and an ink cartridge (not shown) are integrated.

The print head 41 can eject, for example, cyan (C; CYAN), magenta (M; MAGENTA), and yellow (Y; YELLOW) inks. The type of ink provided in the print head 41 is not limited to this.

The head movement mechanism 49 includes an X-direction movement mechanism (not shown) that moves the print head 41 in the left-right direction (X direction) of the apparatus and a Y-direction movement mechanism (not shown) that moves the print head 41 in the front-rear direction (Y direction) of the apparatus.

The X-direction movement mechanism includes an X-direction movement motor 46, and the X-direction movement motor 46 is driven to move the print head 41 in the left-right direction (X-direction) of the apparatus. Further, the Y-direction movement mechanism includes a Y-direction movement motor 48, and the Y-direction movement motor 48 is driven to move the print head 41 in the front-rear direction (Y direction) of the apparatus.

The operations of the X-direction movement motor 46, the Y-direction movement motor 48, and the print head 41 (the ejection mechanism unit of the print head 41) of the head movement mechanism 49 are controlled by a print control unit 313 (see FIG. 2) of the control device 30.

In addition, an imaging unit 50 that images the nail T (finger U including the nail T) exposed from the window portion 63 to acquire the image of the nail T (the image of the finger U including the nail T, hereinafter referred to as a "nail image") is provided inside the upper face (top plate) of the housing 2, and at the position above the window portion 63 of the finger holding unit 6.

The imaging unit 50 includes, for example, an imaging device 51 such as a camera and a lighting device 52 composed of a white LED or the like that illuminates the nail T to be imaged (see FIG. 2).

Further, the imaging unit 50 is connected to an imaging control unit 312 (see FIG. 2) of the control device 30 described later, and is controlled by the imaging control unit 312.

The nail image captured by the imaging device 51 is acquired by the imaging control unit 312.

The image data of the image captured by the imaging unit 50 may be stored in a storage unit 32 described later.

Moreover, in the embodiment, an example in which the imaging device 51 and the lighting device 52 are fixedly disposed at a position, located inside the top face of the housing 2, where the imaging device 51 and the lighting device 52 are able to face the nail T (the surface of the nail T) of the finger U placed in the finger holding unit 6 is described. The imaging unit 50, however, may be provided at a position where the nail T of the finger U placed in the finger holding unit 6 can be imaged, and the specific arrangement is not particularly limited.

For example, the imaging unit 50 may be configured to be movable in the XY directions by the head movement mechanism 49 that moves the print head 41.

The control device 30 is mounted on, for example, a substrate (not shown) disposed inside (lower face side) of the upper face (top plate) of the housing 2.

As shown in FIG. 2, the control device 30 is a computer including the control unit 31 composed of a processor such as a central processing unit (CPU) and the storage unit 32 composed of a read only memory (ROM), a random access memory (RAM), and the like (neither of them is shown).

The storage unit 32 may be configured separately and may be provided outside the control device 30.

The storage unit 32 stores various programs and the like for operating the printing apparatus 100 (particularly, the apparatus main body 1).

Specifically, the storage unit 32 stores various programs such as print programs for performing a printing process, the control unit 31 expands these programs into, for example, a RAM work area, and the programs are executed in the control unit 31 to control each part of the printing apparatus 100 (particularly the apparatus main body 1) in an integrated manner.

From a functional point of view, the control unit 31 includes a communication control unit 311, the imaging control unit 312, the print control unit 313, and the like. The functions as the communication control unit 311, the imaging control unit 312, the print control unit 313, and the like are implemented by the cooperation between the control unit 31 and the program stored in the storage unit 32.

The communication control unit 311 controls the operation of a communication unit 13.

In the present embodiment, the communication unit 13 includes a radio communication module that can communicate with a communication unit 73 and the like of the operation terminal 7, which also functions as an operation unit, and when transmitting and receiving various pieces of data and the like between the apparatus main body 1 and the operation terminal 7, the communication control unit 311 controls the operation of the communication unit 13.

The apparatus main body 1 of the present embodiment prints a nail design (hereinafter, also simply referred to as a "design") in cooperation with an operation terminal 7 described later. For example, the data of the design to be printed on the nail T and the table that determines the application order of the base are stored in the operation terminal 7, and the communication control unit 311 appropriately controls the communication by the communication unit 13 to acquire the design data, the table, and the like from the operation terminal 7 via the communication unit 13.

Further, in the present embodiment, the nail image captured by the imaging unit 50 of the apparatus main body 1 is transmitted to the operation terminal 7. As will be described later, a control unit 81 of the operation terminal 7 detects the contour shape and the like of the nail T based on the nail image to generate print data. Then, the generated print data and the like are transmitted to the apparatus main body 1 via the communication units 73 and 13.

Communication between the apparatus main body 1 and the operation terminal 7 may be performed through a network line such as the Internet, or may be performed through, for example, radio communication based on a short distance radio communication standard such as Bluetooth (registered trademark) or Wi-Fi. When performing communication via a network, any line may be used as the network used for communication.

The communication unit 13 may be any unit capable of communicating with the operation terminal 7, and the communication unit 13 that matches the communication standard of the communication unit 73 of the operation terminal 7 is applied.

Communication between the apparatus main body 1 and the operation terminal 7 is not limited to wireless, and various pieces of data may be transmitted/received between the two by a wired connection.

For example, a configuration may be such that a connector portion (not shown) that can be connected to a connector portion (not shown) of the operation terminal is provided inside the attachment port 25, and when the connectors are connected to each other, information can be mutually transmitted and received via the connector portions.

The imaging control unit 312 controls the imaging device 51 and the lighting device 52 of the imaging unit 50 to cause the imaging device 51 to capture the image of the finger U (nail image) including the image of the nail T of the finger U placed in the finger holding unit 6.

The image (nail image) of the nail T acquired by the imaging unit 50 is transmitted to the imaging control unit 312. In the present embodiment, the nail image (data of the image of the nail T) is transmitted from the apparatus main body 1 to the operation terminal 7 and acquired by the control unit 81 of the operation terminal 7. The imaging control unit 312 may store the nail image in the storage unit 32.

The print control unit 313 causes the printing unit 40 to perform printing on the nail T according to the print data generated by the print data generation unit 814.

Specifically, the print control unit 313 outputs the control signal to the printing unit 40 based on the print data to control the X-direction movement motor 46, the Y-direction movement motor 48, the print head 41, and the like of the printing unit 40 so that the printing unit 40 performs printing on the nail T according to the print data.

As will be described later, the print data generated by the print data generation unit 814 is transmitted from the operation terminal 7 to the apparatus main body 1, and the control unit 31 outputs this print data to the print control unit.

The print control unit 313 controls the printing unit 40 based on this print data, and causes the printing unit 40 to sequentially print, based on the print order set by the print data generation unit 814 as a print order setting unit, the pre-stored design on the surface of the nail T on which printing is to be performed.

Further, as described above, in the present embodiment, the control unit 31 also acquires the state of attachment/detachment of the operation terminal 7 to the attachment port 25.

That is, when the attachment/detachment detection unit 15 detects that the operation terminal 7 is attached to the attachment port 25, the attachment/detachment detection unit 15 transmits the detection signal to the control unit 31.

In the embodiment, the detection result by the attachment/detachment detection unit 15 is the practitioner information (treatment subject information among the practitioner information) described later, and is transmitted from the apparatus main body 1 to the operation terminal 7 via the communication units 13, and 73 to be acquired by the control unit 81 as an information acquisition unit.

The practitioner information will be described in detail later.

Further, as described above, the printing apparatus 100 of the present embodiment includes the operation terminal 7 as an operation unit configured to be removable from the apparatus main body 1.

As shown in FIG. 2, the operation terminal 7 includes the operation unit 71, a display unit 72, the communication unit 73, a control device 80, and the like.

The operation unit 71 can perform various inputs and settings according to the operation by a user who is a person having the nail T on which printing is performed (person to be treated), the practitioner P, or the like. The operation unit 71 is a touch panel integrally provided on the surface of the display unit 72, for example. When the operation unit 71 is operated, an input signal corresponding to the operation is transmitted to the control unit 81.

Various operation screens are displayed on the touch panel of the display unit 72 according to the control of the display control unit 812 described later, and the user can perform various input/setting operations by touching the touch panel.

The operation unit 71 for performing various input/setting operations is not limited to the touch panel. For example, various operation buttons, a keyboard, a pointing device, and the like may be provided as the operation unit 71.

In the present embodiment, when the user operates the operation unit 71, various instructions such as printing start are output from the operation terminal 7 to the apparatus main body 1, and the operation terminal 7 functions as an operation unit of the printing apparatus 100.

Further, the user or the like can select the nail design to be printed on the nail T by operating the operation unit 71.

Further, in the present embodiment, a liquid agent that receives ink is applied as a base to the surface of the nail T on which printing is to be performed before printing.

The operation unit 71 of the operation terminal 7 can input the practitioner information about the practitioner P (see FIGS. 3 to 6) who performs the treatment of applying the base. The information input from the operation unit 71 is acquired by the control unit 81 as an information acquisition unit.

When there is practitioner information acquired by the control unit 31 of the apparatus main body 1, this information is also transmitted to the operation terminal 7 and acquired by the control unit 81.

Here, the practitioner information in the present embodiment includes the information on the dominant hand of the practitioner P, and the treatment subject information as to whether the practitioner P who is the main entity performing the treatment of applying the base is a person having the nail T on which printing is performed (in this case, the practitioner P and the person to be treated are identical) or another person different from the person.

Further, the practitioner information may include various pieces of information about the practitioner P other than these.

In addition, when the printing apparatus 100 is used in stores in which the practitioner P is another person (a store staff member, and the like) different from a person having the nail T on which printing is performed or when the printing apparatus 100 is used assuming that only the personal having the nail T on which printing is performed uses it privately, the treatment subject information may be dedicated to the another person or the person to be treated, and it may not be necessary to acquire the treatment subject information.

In the present embodiment, the information on the dominant hand of the practitioner P among the practitioner information is input when a person having the nail T on which printing is performed or the practitioner P who is another person operates the operation unit 71.

Further, the treatment subject information is detected by the attachment/detachment detection unit 15 provided in the apparatus main body 1, and is acquired by the control unit 81 based on the detection result transmitted to the operation terminal 7.

Both the information on the dominant hand and the treatment subject information may be input from the operation terminal 7.

In addition, once the control unit 81 acquires the practitioner information (that is, the information on the dominant hand and the treatment subject information), the practitioner information is stored in the storage unit 82, etc., and after that, it may be applied as a default unless the setting is changed by the user who is a person having the nail T on which printing is performed or the practitioner P or the like who is another person.

Figure 3:
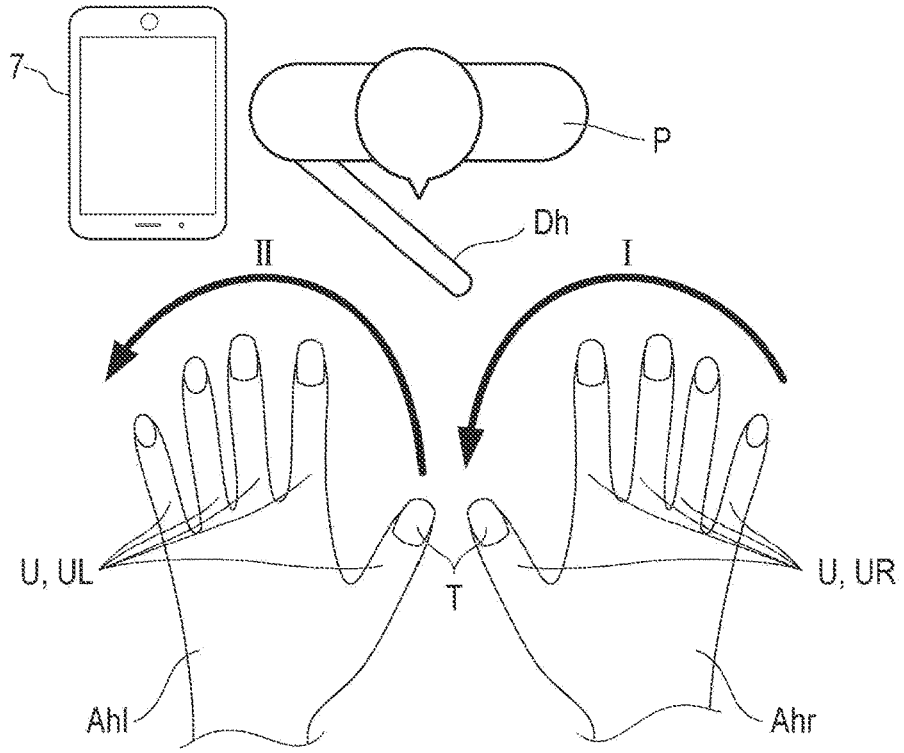
FIG. 3 is a diagram showing a concept of the base application order when a practitioner who applies the base is a right-handed another person different from a person having the nail on which printing is performed.
Figure 4:
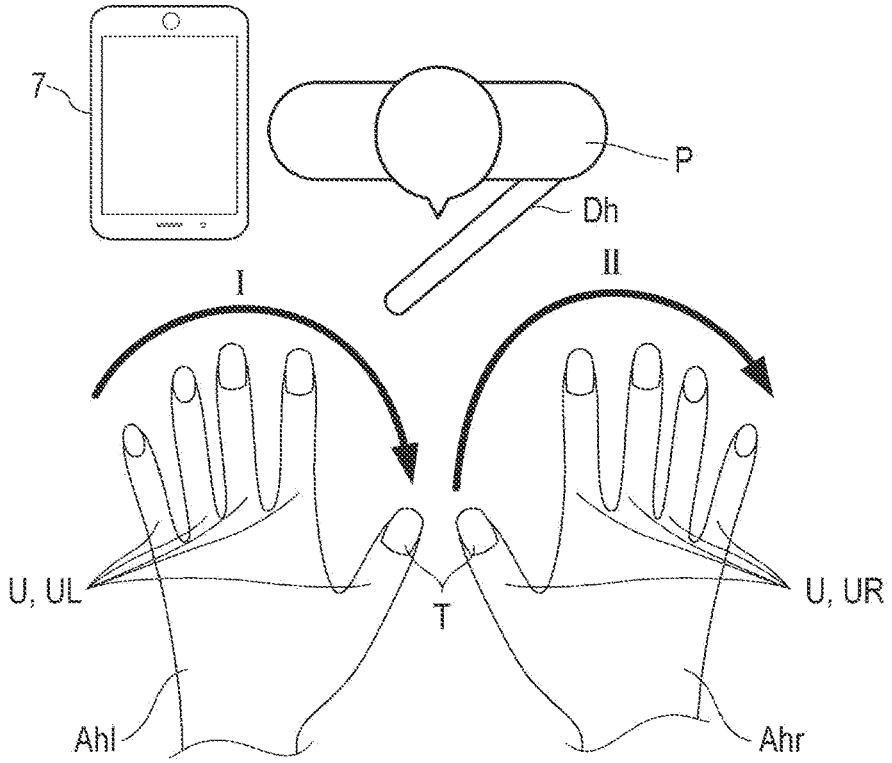
FIG. 4 is a diagram showing a concept of the base application order when the practitioner who applies the base is a left-handed another person different from a person having the nail on which printing is performed.

FIGS. 3 and 4 are conceptual diagrams in which the practitioner P who performs the treatment of applying the base to the surface of the nail T on which printing is to be performed is not a person having the nail on which printing is performed, but another person facing this person (person to be treated), who performs a treatment on the nails T of the hands Ahr and Ahl of the person to be treated.

The another person is, for example, a staff member or a nail technician who provides a nail print service, or a third party different from a person having the nail T on which printing is performed, such as a friend of the person having the nail T on which printing is performed.

In this case, only the apparatus main body 1 is disposed so as to face the person having the nail T on which printing is performed. Since it is assumed that the practitioner P, who is another person, inputs data to and checks various screens of the operation terminal 7, it is assumed that the practitioner P removes it from the apparatus main body 1 and places it close by for operation as shown in FIGS. 3 and 4.

Therefore, when the detection result by the attachment/detachment detection unit 15 indicates that the operation terminal 7 is not attached to the apparatus main body 1, the control unit 81 determines that the practitioner P is another person different from a person having the nail T on which printing is performed.

Figure 5:
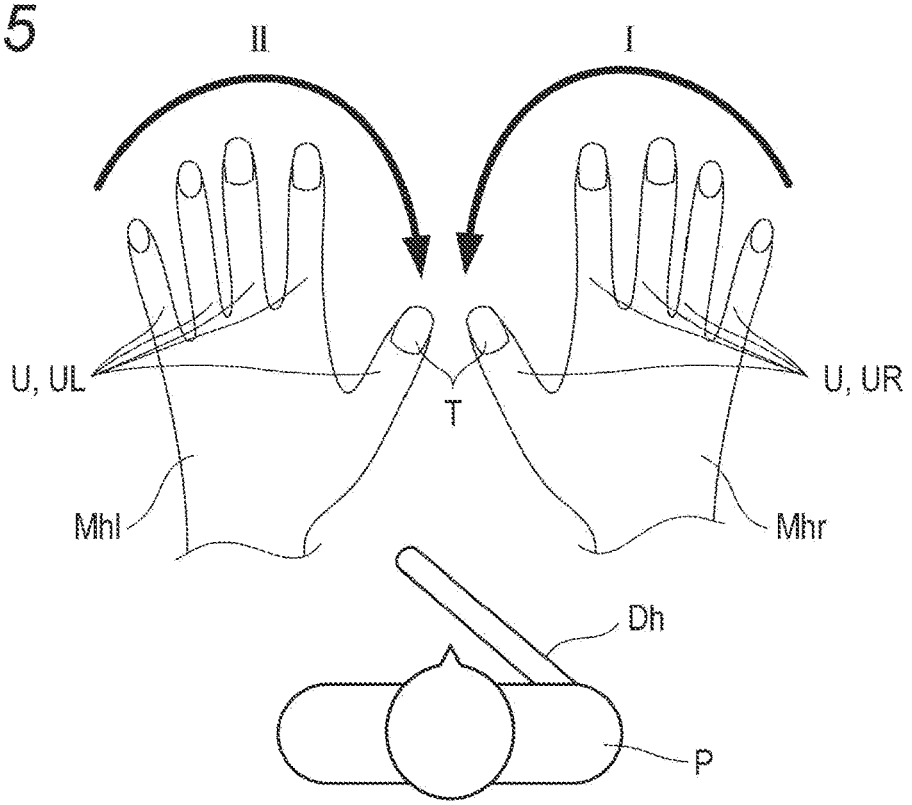
FIG. 5 is a diagram showing a concept of the base application order when the practitioner who applies the base is a right-handed person having a nail to which the base is applied.
Figure 6:
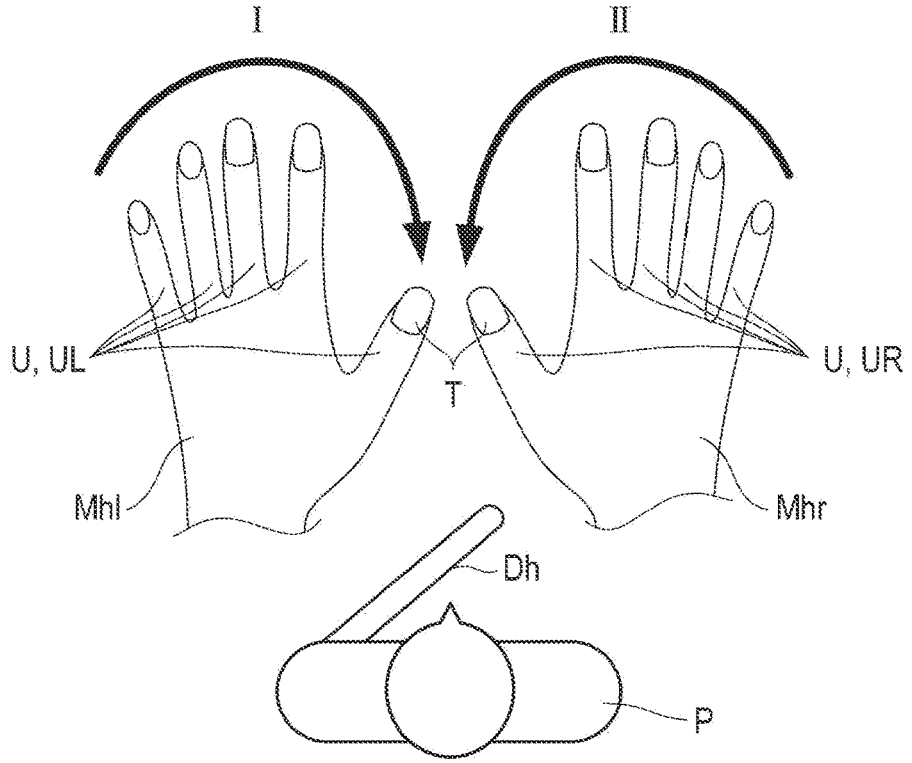
FIG. 6 is a diagram showing a concept of the base application order when the practitioner who applies the base is a left-handed person having a nail to which the base is applied.

On the other hand, FIGS. 5 and 6 are conceptual diagrams in which the practitioner P who performs the treatment of applying the base to the surface of the nail T on which printing is to be performed is a person having the nail T and performing printing on the nail T (that is, the practitioner P and the person to be treated are identical). In this case, the hands to be treated are the hands of the person to be treated, Mhr and Mhl.

In this case, it is assumed that the person who is the practitioner P and the person to be treated performs various operations with the operation terminal 7 attached to the apparatus main body 1. Therefore, when the detection result by the attachment/detachment detection unit 15 indicates that the operation terminal 7 is attached to the apparatus main body 1, the control unit 81 determines that the practitioner P is a person having the nail T on which printing is performed (person to be treated).

The display unit 72 is composed of, for example, a liquid crystal display (LCD), an organic electroluminescence display, or various other flat displays.

As described above, a touch panel for performing various inputs may be integrally configured on the surface of the display unit 72. In this case, the touch panel functions as the operation unit 71.

In the present embodiment, the nail design input/selected from the operation unit 71 by the person having the nail T on which printing is performed, various guidance screens, warning display screens, and the like can be displayed on the display unit 72.

Further, when the imaging unit 50 of the apparatus main body images the finger holding unit 6 and its surroundings as continuous still images or moving images, the operation terminal 7 sequentially acquires the images and displays the live view image on the display unit 72.

Moreover, in the embodiment, as will be described later, when performing printing on the nails T of a plurality of fingers U, the print order is set based on the practitioner information, and the set print order is displayed on the display unit 72, and a print instruction screen (see FIG. 9) that prompts the person having the nail T on which printing is performed to set the fingers U on the finger holding unit 6 according to the print order is displayed on the display unit 72.

The communication unit 73 is configured to be able to communicate with the communication unit 13 of the apparatus main body 1.

As described above, communication between the apparatus main body 1 and the operation terminal 7 may be through either a wireless connection method or a wired connection method, and the specific method is not limited. The communication unit 73 may be any unit capable of communicating with the apparatus main body 1, and the communication unit 73 that matches the communication standard of the communication unit 13 of the apparatus main body 1 is applied.

The communication unit 13 is connected to a communication control unit 811 (see FIG. 2) of the control device 80 described later, and is controlled by the communication control unit 811.

As shown in FIG. 2, the control device 80 of the operation terminal 7 of the present embodiment is a computer including a control unit 81 composed of a processor such as a central processing unit (CPU) (not shown) and a storage unit 82 composed of a read only memory (ROM) and a random access memory (RAM) (not shown).

The storage unit 82 stores various programs, various pieces of data, and the like for operating each unit of the operation terminal 7.

Specifically, the ROM and the like of the embodiment stores, in addition to an operation program 821*a* for overall control of each part of the operation terminal 7, various programs such as a nail print application program 821*b* (hereinafter referred to as a "nail print AP") for performing nail printing using the apparatus main body 1, the control unit 81 develops these programs into, for example, a RAM work area, and the programs are executed by the control unit 81 to control each part of the operation terminal 7 in an integrated manner.

Further, the storage unit 82 of the present embodiment has a design storage area 822 or the like that stores nail design (design) data.

The nail design (design) stored in the design storage area 822 may be an existing design prepared in advance, or a design created by a person having the nail T on which printing is performed.

In the embodiment, when it is expected to perform printing on the nails T of a plurality of fingers U, a data set of the nail design (design) is prepared in advance in which the design to be printed on the nails T of all fingers U (for example, 10 fingers U of the left and right hands), on which printing is to be performed is associated with each finger type, and is stored in the design storage area 822.

In this case, it is preferable that the design data set is associated with information for identifying the user, such as the name of the person having the nail T on which printing is performed. This allows the user to easily acquire the dataset of his/her favorite design and use it for nail printing at the next time and later.

Further, when the operation terminal 7 can be connected to various networks, it may be possible to take in the nail design (design) stored in a server device or the like (not shown) that can be connected to the network.

Further, the storage unit 82 of the present embodiment has a nail information storage area 823 in which various types of nail information detected by a nail information detection unit 813, which will be described later, are stored.

The nail information storage area 823 includes, for example, the nail contour which is the contour shape of the nail, the curvature of the nail which indicates the degree of curvature of the nail, and the like. The nail information stored in the nail information storage area 823 may include various other information.

Further, in the present embodiment, the storage unit 82 has a practitioner information storage area 824 in which the practitioner information about the practitioner P (information on the dominant hand of the practitioner P, treatment subject information indicating whether the practitioner P is a person to be treated or another person, and the like) is stored.

In addition to the practitioner information, for example, a table in which the print order set from the order of base application determined from the practitioner information and the finger type of each nail are associated with each other is stored in the practitioner information storage area 824.

FIG. 7A is an example of a right-handed person table and a left-handed person table when the practitioner is another person.

In addition, FIG. 7B is an example of a right-handed person table and a left-handed person table when the practitioner is the person to be treated (the person having the nail on which printing is performed).

When the practitioner P is another person (for example, a staff member of the shop) different from a person having the nail T on which printing is performed, as shown in FIG. 3, the practitioner P performs the treatment of applying the base to the nails T of the hands Ahr and Ahr of the person to be treated while facing the person to be treated who is a person having the nail T on which printing is performed.

FIG. 3 schematically illustrates that the dominant hand Dh of the practitioner P is the right hand.

In this case, as in the example shown in FIG. 3, when the practitioner P is right-handed (that is, the dominant hand Dh is the right hand), the base is generally applied to the nails T toward one direction starting from a nail T of the finger U located farthest from the dominant hand Dh. That is, first, the base is applied sequentially from the nail T of the little finger UR of the right hand Ahr of the person to be treated facing the practitioner P to the nail T of the thumb UR of the right hand Ahr (thick arrow indicated by "I" in FIG. 3), and then the base is applied sequentially from the nail T of the thumb UL of the left hand Ahl of the person to be treated to the nail T of the little finger UL of the left hand Ahl (thick arrow indicated by "II" in FIG. 3).

FIG. 4 schematically illustrates that the practitioner P is another person different a person having the nail T on which printing is performed, and the dominant hand Dh of the practitioner P is the left hand.

As in the example shown in FIG. 4, the same also applies to the case when the practitioner P is left-handed (the dominant hand Dh of the practitioner P is the left hand). The base is sequentially applied from the finger located farthest from the dominant hand Dh, that is, the nail T of the little finger UL of the left hand Ahl of the person to be treated facing the practitioner P to the nail T of the thumb UL of the left hand Ahl (thick arrow denoted by "I" in FIG. 4), and then the base is applied sequentially from the nail T of the thumb UR of the right hand Ahr of the person to be treated to the nail T of the little finger UR of the right hand Ahr (thick arrow indicated by "II" in FIG. 4).

By applying the base in such a procedure, the hand of the practitioner P does not pass over the already applied base, and it is possible to prevent the hand from carelessly touching the nail T to come off the base, or the base from contacting the hand to make other parts dirty.

Since the base will be dried in order in which the base applied, printing can be performed in order in which the base is applied to minimize the waiting time for drying, and printing can be performed efficiently.

Therefore, when the practitioner P is another person, the table TBLa for each dominant hand is as shown in FIG. 7A.

On the other hand, when the practitioner P is a person having the nail T on which printing is performed (that is, the practitioner P and the person to be treated are identical), as shown in FIG. 5, the practitioner P performs the treatment of applying the base to the nails T of the fingers U of his or her own hands Mhr and Mhr one by one.

In this case, in order to apply the base with less mistake, it is preferable to apply the base from the dominant hand Dh with which detailed work can be performed.

FIG. 5 schematically illustrates that the dominant hand Dh of the practitioner P, who is a person having the nail T on which printing is performed, is the right hand.

As in the example shown in FIG. 5, when the practitioner P (the person to be treated) is right-handed (that is, the dominant hand Dh is the right hand), first, the base is applied sequentially with the left hand from the nail T of the finger UR (little finger of the right hand Mhr) located at the outside the right hand Mhr, which is the dominant hand Dh, to the nail T of the thumb UR of the right hand Mhr (thick arrow indicated by "I" in FIG. 5). Then, with the right hand Mhr, which is the dominant hand Dh, the base is sequentially applied from the nail T of the little finger UL of the left hand Mhl to the nail T of the thumb UL of the left hand Mhl (thick arrow indicated by "II" in FIG. 5).

FIG. 6 schematically illustrates that the practitioner P is a person having the nail T on which printing is performed and the dominant hand Dh of the practitioner P is the left hand.

As in the example shown in FIG. 6, the same applies when the practitioner P is left-handed (dominant hand Dh of the practitioner P is the left hand), and first, the base is applied sequentially with the right hand Mhr from the nail T of the finger UL (little finger of the left hand Mhl) located at the outside of the left hand Mhl, which is the dominant hand Dh, to the nail T of the thumb UL of the left hand Mhl (thick arrow indicated by "I" in FIG. 6). Then, with the left hand Mhl, which is the dominant hand Dh, the base is applied from the little finger UR of the right hand Mhr to the thumb UR of the right hand Mhr (thick arrow indicated by "II" in FIG. 6).

By applying the base in such a procedure, the hand of the practitioner P does not pass over the already applied base, and it is less likely to make a mistake in which the hand carelessly touches the nail T to come off the base, or the base contacts the hand to make other parts dirty.

Since the base will be dried in order in which the base applied, printing can be performed in order in which the base is applied to minimize the waiting time for drying, and printing can be performed efficiently.

Therefore, when the practitioner P is a person having the nail on which printing is performed (the person to be treated), the table TBLb for each dominant hand is as shown in FIG. 7B.

From a functional point of view, the control unit 81 of the operation terminal 7 includes the communication control unit 811, the display control unit 812, the nail information detection unit 813, the print data generation unit 814, and the like. The functions of the communication control unit 811, the display control unit 812, the nail information detection unit 813, the print data generation unit 814, and the like are implemented by the cooperation between the CPU of the control unit 81 and the program stored in the ROM of the storage unit 82.

The function provided by the control unit 81 of the operation terminal 7 is not limited to this, and various other function units may be provided.

For example, when performing printing on the nails of a plurality of fingers in a series of printing operations, the control unit 81 of the present embodiment functions as a treatment order determination unit that determines, based on the practitioner information, the base application order in which the practitioner P who applies the base performs the treatment on the nails T of the plurality of fingers U.

Specifically, the control unit 81 determines the base application order by referring to the tables TBLa and TBLb (see FIG. 7A and FIG. 7B) in which practitioner information about whether the practitioner P is a person to be treated or another person, and whether the dominant hand Dh is the right hand or the left hand in each case is associated with information about in which order the base is applied.

The tables TBLa and TBLb illustrated here are examples derived from general trends. Normally, the control unit 81 can determine the base application order by applying the tables TBLa and TBLb.

However, for example, when the practitioner P who is a person having the nail T on which printing is performed or another person has an order that is different from the order specified on the tables TBLa and TBLb and in which it is easy for the practitioner P to perform application, this order may be registered in advance. In this case, by associating the information on the order with the information that identifies the practitioner P (for example, the name of the practitioner P), for example, when the name of the practitioner P is entered to select whether the practitioner P performs the treatment on his/her own nail T as a person to be treated or performs the treatment on the nail T of another person as a person different from himself/herself, the control unit 81 may read out the table of the base application order corresponding to the practitioner P to determine the base application order.

The communication control unit 811 controls the operation of the communication unit 73.

Further, the display control unit 812 controls the display unit 72 to display various display screens on the display unit 72.

Further, in the present embodiment, as described above, the control unit 81 of the operation terminal 7 functions as an image acquisition unit that acquires a nail image (data of an image of the nail T).

The nail information detection unit 813 is a control unit that detects nail information about the nail T of the finger U based on the image of the nail T (nail image). In the present embodiment, the nail information detection unit 813 specifically detects the nail contour that defines the region of the nail T of each finger U. When the color of the base applied to receive the ink is white, the nail information detection unit 813 detects the nail contour by looking at the difference in color between the part to which the base is applied and the skin-colored part to which the base is not applied.

The data of "nail contour" as nail information is a contour shape of the nail T (nail shape, the XY coordinates of the horizontal position of the nail T, and the like) represented by a plurality of contour points (for example, tens to thousands of points) in a predetermined rectangular image.

The nail contour information on the nail T acquired by the nail information detection unit 813 is stored in the nail information storage area 823 of the storage unit 82 in association with the finger type of the finger U having the nail T.

The nail information detected by the nail information detection unit 813 is not limited to this.

The nail information detected by the nail information detection unit 813 may include, for example, the inclination angle of the surface of the nail T with respect to the XY plane (inclination angle of the nail T, nail curvature) and the like. Further, when the height of the nail T (the position of the nail T in the vertical direction) can be acquired from an image or the like captured by the imaging device 51, the height of the nail T may be also included in the nail information.

The print data generation unit 814 generates print data that is a design matching the nail contour stored in the nail information storage area 823.

That is, the print data generation unit 814 is a print data generation unit that generates print data for each finger U by matching the desired design with the nail contour of the nail T detected by the nail information detection unit 813 and stored in the nail information storage area 823.

Specifically, the print data generation unit 814 extracts the image data of the nail design (design) selected by the user or the like to perform adjustment of the enlargement/reduction and the arrangement as appropriate, and fits it to the nail contour detected from the image of nail T.

When the nail information detection unit 813 acquires the curvature of the nail T or the like, the print data generation unit 814 may appropriately perform the curved surface correction on the print data based on the curvature of the nail T or the like. When the curved surface correction is performed, it is possible to generate print data that matches the shape of the nail T more suitably.

The print data generation unit 814 of the present embodiment stores the print data generated for each finger U as, for example, a data set consisting of 10 fingers of both left and right hands as one set (see, for example, the concept shown in FIG. 9) in the storage unit 82 in association with information such as the name and the finger type of a person having the nail T on which printing is performed.

Moreover, in the embodiment, the print data generation unit 814 also functions as a print order setting unit that sets the print order for the nails T of a plurality of fingers U according to the base application order determined by the control unit 81 as the treatment order determination unit.

The print data generation unit 814 as the print order setting unit sets the print order for the nails T of a plurality of fingers U so that printing is performed on the nails T starting from a nail T of the finger U which is determined by the control unit 81 as the treatment order determination unit to be an earliest finger in order of the base application order.

Then, the print data of the design to be sequentially printed on the nail T of each finger U is transmitted to the apparatus main body 1 according to the set order.

The print data transmitted to the apparatus main body 1 at the time of printing is data for printing for printing a design with the range of the nail contour as a print region when the XY coordinates indicating the contour position of the nail T of the finger U set in the finger holding unit 6 are detected at the time of printing.

That is, the print data generation unit 814 of the present embodiment generates and prepares a data set of print data in advance, and also generates data for printing that matches the actual position of the nail T at the time of printing.

Note that the print data is not limited to be sequentially transmitted from the operation terminal 7 to the apparatus main body 1, and one data set may be collectively transmitted to the apparatus main body 1. In this case, at the time of printing, the control unit 31 or the like of the apparatus main body 1 generates data for printing that matches the actual position of the nail T of each finger U.

Next, the printing control method of the present embodiment will be described with reference to FIG. 8 and the like.

Figure 8:
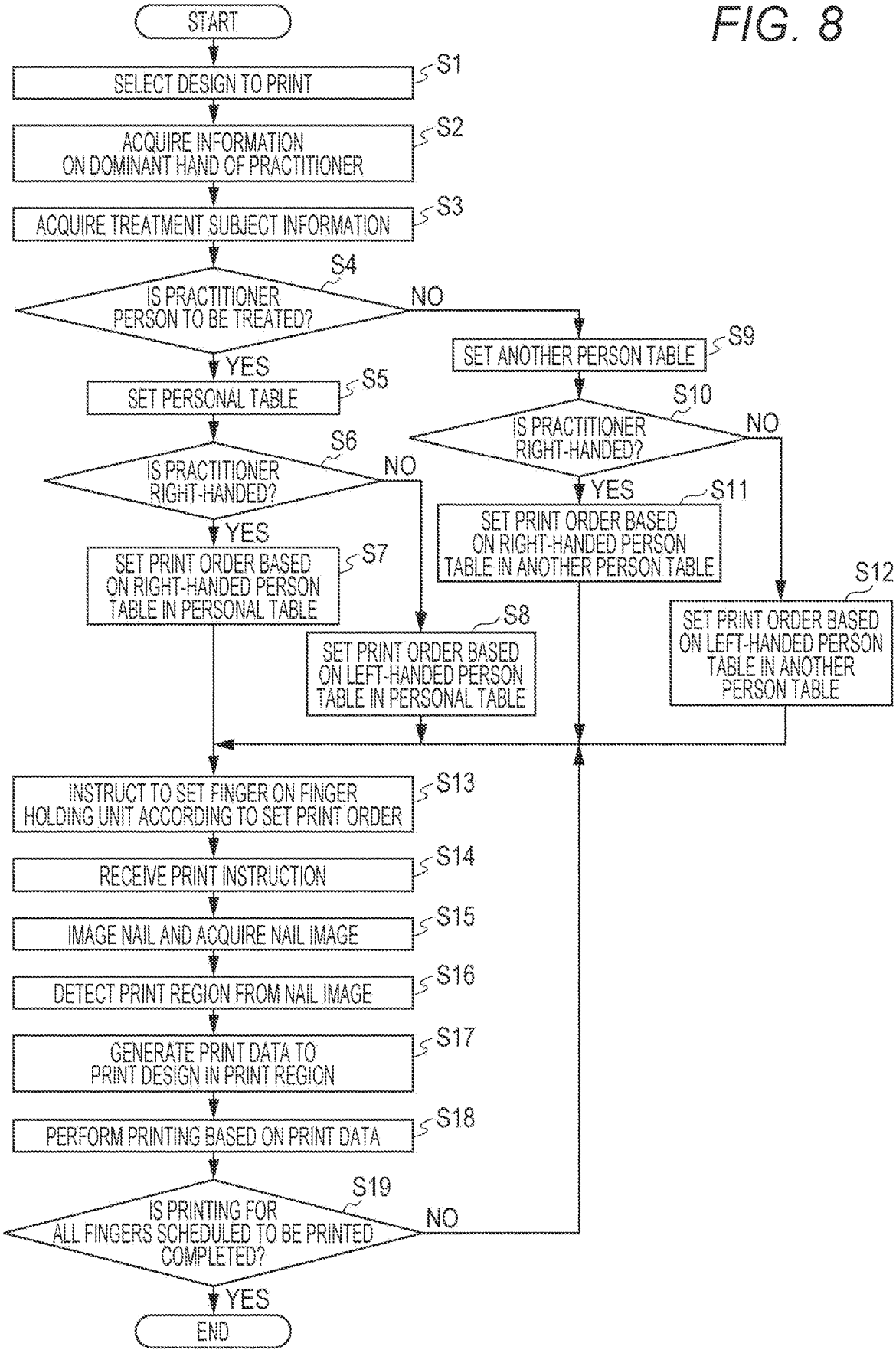
FIG. 8 is a flowchart showing a printing process according to the present embodiment.

FIG. 8 is a flowchart of the printing process according to the present embodiment.

When performing nail printing using the apparatus main body 1 of the present embodiment, the user operates the operation unit 12 (operation button) of the apparatus main body 1 to turn on the power and start the operation.

Also, the power of the operation terminal 7 is turned on and the execution of the nail print process is selected from the operation unit 71 of the operation terminal 7. This activates the nail print AP821*b*.

When the nail print AP821*b* is activated in the operation terminal 7, the display control unit 812 of the operation terminal 7 prompts the user to select the design to be printed on the nail T.

Specifically, the display unit 72 displays a list of designs and the like, and displays a message and the like prompting the user to select a desired design. Then, when the user selects one of the designs by operating the operation unit 71 or the like of the operation terminal 7, the operation signal is output to the control unit 81, and as shown in FIG. 8, the design to be printed is selected (step S1).

In the present embodiment, before printing is started, first, the treatment of applying the base to the nails T of all the fingers U, on which printing is to be performed is performed.

For example, when performing printing on the nails T of all 10 fingers U of both left and right hands, the order in which the practitioner P applies the base is, as mentioned above, determined to some extent by the conditions of the practitioner P, such as whether the dominant hand Dh of the practitioner P is left or right, and whether the practitioner P is a person to be treated or another person such as a staff member of the store, and can be determined by the information about the practitioner P. Then, since the base dries in order of applying the base, it is preferable to perform printing in the same order as the base application order.

Therefore, in the present embodiment, the control unit 81 acquires the practitioner information, which is the information about the practitioner P, and sets the print order based on the practitioner information.

That is, specifically, first, a screen prompting the practitioner P to input the information on the dominant hand of the practitioner P who performs the treatment of applying the base is displayed on the display unit 72, and the practitioner P (a person having the nail T on which printing is performed or another person different from the person) is caused to input the information on the dominant hand.

As a result, the control unit 81 as the information acquisition unit acquires the information on the dominant hand of the practitioner P (step S2).

Further, the control unit 81 as an information acquisition unit acquires, from the apparatus main body 1, the state of attachment/detachment of whether the operation terminal 7 is attached to the attachment port 25 of the apparatus main body 1 as the treatment subject information (or information for determining the practitioner P) (step S3).

The control unit 81 determines whether the practitioner P is a person to be treated from the attachment/detachment information on the operation terminal 7 (step S4), and when the practitioner P is the person to be treated (step S4; YES, see FIGS. 5 and 6), sets the "personal table" illustrated in FIG. 7B (step S5).

Further, the control unit 81 determines whether the practitioner P is right-handed (step S6), and when the practitioner P is right-handed (step S6; YES, see FIG. 5), sets the print order in a series of printing so that printing is performed on the nail T of each finger U in the same order as the base application based on the right-handed person table in the "personal table" (step S7).

When the practitioner P is left-handed (step S6; NO, see FIG. 6), the control unit 81 sets the print order in a series of printing so that printing is performed on the nail T of each finger U in the same order as the base application based on the left-handed person table in the "personal table" (step S8).

On the other hand, when the practitioner P is not the person to be treated (step S4; NO, see FIGS. 3 and 4), the "another person table" illustrated in FIG. 7A is set (step S9).

In this case, the control unit 81 also determines whether the practitioner P is right-handed (step S10), and when the practitioner P is right-handed (step S10; YES, see FIG. 3), sets the print order in a series of printing so that printing is performed on the nail T of each finger U in the same order as the base application based on the right-handed person table in the "another person table" (step S11).

When the practitioner P is left-handed (step S10; NO, see FIG. 4), the control unit 81 sets the print order in a series of printing so that printing is performed on the nail T of each finger U in the same order as the base application based on the left-handed person table in the "another person table" (step S12).

When the print order in a series of printing is set, the user is instructed to set the finger U according to the set print order in the finger holding unit 6 (step S13). Specifically, for example, the display control unit 812 controls the display unit 72 to display the print instruction screen 72*a* for displaying the print order and the finger U to be set next in the finger holding unit 6 on the display unit 72, and prompts the user to set the finger U.

Figure 9:
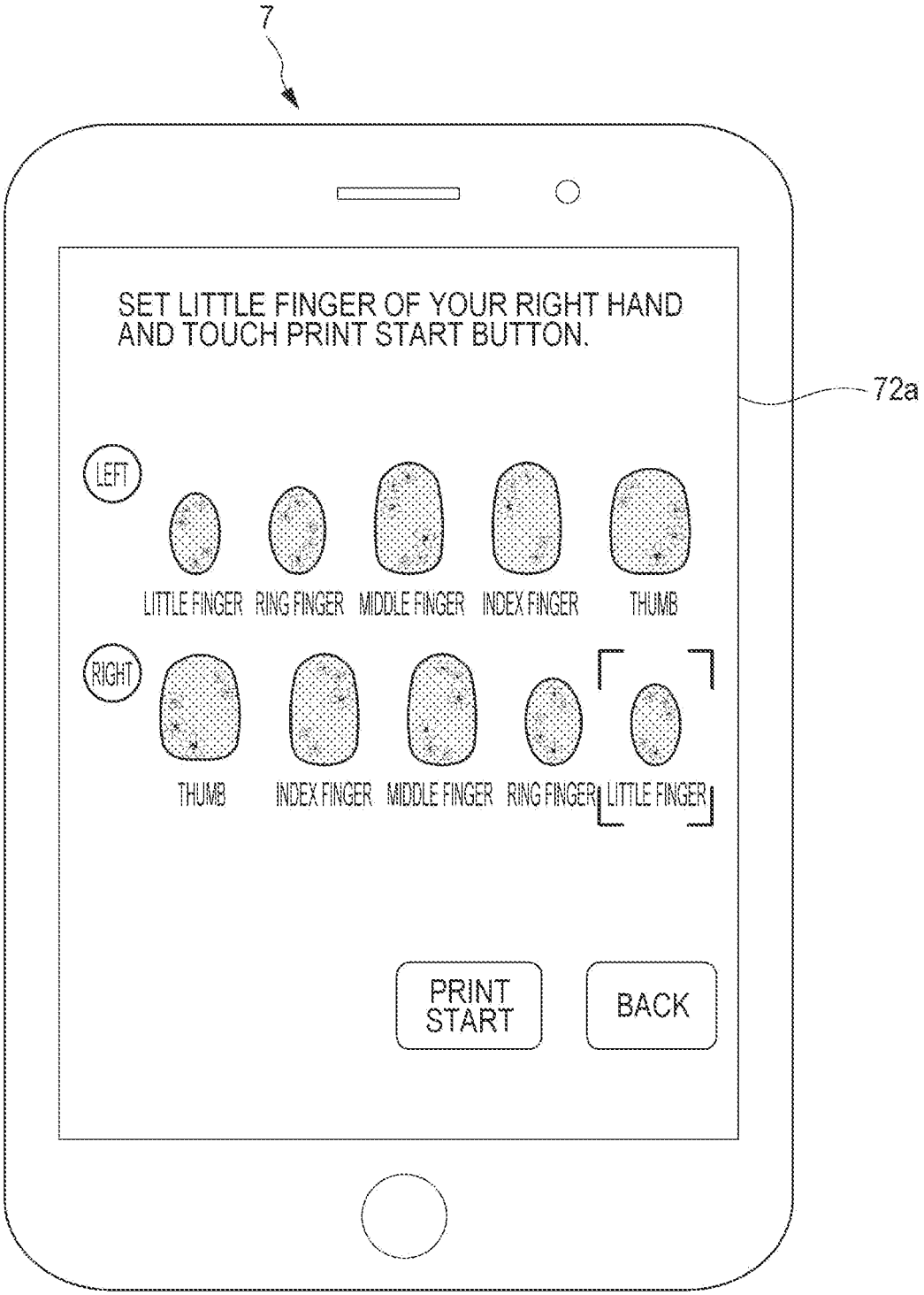
FIG. 9 is a diagram showing an example of a print instruction screen.

FIG. 9 is a diagram showing an example of a print instruction screen.

A print instruction screen 72*a* displays, for example, a design set to be printed on the nail T of each of the left and right fingers U as shown in FIG. 9, and then presents the finger U that is the printing target to the user.

FIG. 9 shows an example in which the next printing is performed on the little finger of the right hand (the right hand Mhr of the practitioner P as a person to be treated or the right hand Ahr of the person to be treated different from the practitioner P), and a message stating that "Set the little finger of your right hand and touch the print start button." is displayed.

The print instruction screen 72*a* has a "print start button" as shown in FIG. 9, for example, and when the user touches the button, a print start instruction signal is output to the control unit 81 and a print instruction is received (step S14).

When the print instruction is received, the instruction is transmitted to the apparatus main body 1, and the imaging control unit 312 causes the imaging unit 50 to image the nail T and acquire the nail image (step S15).

The nail image is transmitted to the operation terminal 7 via the communication units 13 and 73, and transmitted to the control device 80 of the operation terminal 7, and the nail information detection unit 813 detects the nail contour, which is a print region, from the nail image (step S16).

The print data generation unit 814 generates print data (data for printing that matches the position of the nail T at the time of printing) for printing the design in the detected print region (that is, the XY coordinates indicating the contour position of the nail T at the time of printing) (step S17).

The print data is transmitted to the apparatus main body 1, and the control unit 31 outputs the print data to the printing unit 40.

As a result, printing is performed by the printing unit 40 based on the print data (step S18).

The control unit 31 determines whether printing is completed for all the fingers U on which printing is to be performed (that is, whether printing for all the print data of the scheduled set has been performed) (step S19). Then, when there is a nail T of the finger U, on which printing has not been completed (step S19; NO), the process returns to step S13 and the process is repeated.

On the other hand, when printing is completed for all the scheduled nails T of the finger U (step S19; YES), the printing process is terminated.

As a result, the waiting time for the base to dry is shortened as much as possible, and the design desired by the user is efficiently printed on the nail T of each finger U.

The processing procedure shown in FIG. 8 may be omitted.

For example, the process of acquiring the information on the dominant hand of the practitioner P (step S2) and the process of acquiring the treatment subject information about whether the practitioner P is a person having the nail T on which printing is performed or another person different from the person (step S3 and step S4) may be performed in reverse.

As described above, the printing apparatus 100 of the present embodiment performs printing on the nail T to which the base is applied, acquires the practitioner information about the practitioner P who applies the base, and when performing printing on the nails T of a plurality of fingers U, determines, based on the practitioner information, the base application order in which the practitioner P who applies the base performs the treatment on the nails T of the plurality of fingers U. Then, the print order for the nails T of the plurality of fingers U is set according to the determined base application order, and printing is performed based on the print order on the nails T of the plurality of fingers U, to which the base was applied.

As a result, printing can be performed sequentially in the order in which the base is dried, the waiting time for drying can be reduced as short as possible, and the printing process can be completed efficiently and quickly.

Further, in the present embodiment, the practitioner information includes the information on the dominant hand of the practitioner P, the base application order is determined based on this information on the dominant hand, and the print order for the nails T of a plurality of fingers U is set according to the determined base application order.

The base application order (treatment order) of the base application differs depending on whether the dominant hand Dh of the practitioner P is left or right. Even when there is a personal preference or habit of the practitioner P, an efficient and less error-prone application order is assumed according to the dominant hand of the practitioner P. Therefore, efficient printing can be realized by setting the print order for the nails T of a plurality of fingers U in consideration of the information on the dominant hand.

Moreover, in the embodiment, the practitioner information includes the treatment subject information about whether the practitioner P is a person having the nail T on which printing is performed or another person different from the person, determines the base application order based on this treatment subject information, and sets the print order for the nails T of a plurality of fingers U according to the determined base application order.

The treatment order of base application (base application order) differs depending on whether the practitioner P is a person having the nail T on which printing is performed or another person different from the person such as a salon staff member facing the person. Even when there is a personal preference or habit of the practitioner P, an efficient and less error-prone application order is assumed according to the practitioner P. Therefore, efficient printing can be realized by setting the print order for the nails T of the plurality of fingers U in consideration of the treatment subject information.

Further, in the present embodiment, the print order of the nails T of a plurality of fingers U is set so that printing is performed on the nails T starting from a nail T of the finger U of which treatment order of base application is determined to be the earliest.

It takes some time for the base to dry after application, and unless printing is performed after the base sufficiently dries, ink bleeding or the like will occur, and high-quality printing cannot be performed.

In this regard, it is possible to efficiently realize high-quality printing by performing printing in order from a base determined to be earliest base in order of applying the base.

Further, in the present embodiment, the storage unit 82 which pre-stores the designs printed on the nails T of the plurality of fingers U in association with each finger type is further provided, and the printing unit 40 sequentially prints the designs stored in advance according to the print order.

As a result, even when a different design is set for the nail T of each finger U, a desired design can be efficiently printed on each nail T.

Further, in the present embodiment, the operation terminal 7 is provided as an operation unit that is configured to be removable from the apparatus main body 1, and the state of attachment/detachment of whether the operation terminal 7 is attached to or removed from the apparatus main body 1 is used as the practitioner information.

When the operation terminal 7 is attached to the apparatus main body 1, it is assumed that a person having the nail T on which printing is performed is performing the treatment or the like with the operation terminal 7 attached to the apparatus main body 1 in front of the person. When the operation terminal 7 is removed from the apparatus main body 1, it is assumed that another person facing the person is performing the treatment or the like while looking at the operation terminal 7.

Therefore, in particular, the treatment subject information about whether the practitioner P is a person to be treated or another person different from the person can be determined with a high probability by looking at the state of attachment/detachment of the operation terminal 7. In this case, since the device can automatically make a determination, the burden of input by the user or the like can be reduced.

Although the embodiments of the present disclosure have been described above, it goes without saying that the present disclosure is not limited to such embodiments and can be variously modified without departing from the gist thereof.

For example, in the embodiment, although the case where the operation terminal 7 as an operation unit configured to be removable from the apparatus main body 1 is a dedicated tablet terminal constituting the printing apparatus 100 is illustrated, the operation unit that is configured to be removably attached to the attachment port 25 is not limited to the dedicated operation terminal 7 of the printing apparatus 100. For example, it may be a smartphone or tablet-type terminal device owned by the user.

The attachment port 25 may be configured to accept a plurality of types of operation terminals 7 (for example, smartphones, tablet-type terminal devices, and the like). In this case, the attachment port 25 is formed in a size that can accommodate, among the operation terminals 7 that are expected to be mounted, one having the largest size.

When the operation unit detachably attached to the apparatus main body 1 is a terminal device such as a smartphone, it can be configured as a printing system including a plurality of independent devices such as a printing apparatus 100 and a terminal device.

In this case as well, high-quality printing can be efficiently realized by setting the print order for the nail T based on the information of the practitioner P who applies the base.

Moreover, in the embodiment, the configuration is such that the attachment/detachment detection unit 15 composed of a push switch or the like is provided inside the attachment port 25, and the attachment/detachment detection unit 15 detects the state of attachment/detachment of the operation terminal 7, but the configuration that detects the state of attachment/detachment of the operation terminal 7 is not limited to this.

For example, the attachment/detachment detection unit 15 may include a photo sensor or the like.

Further, the attachment/detachment detection unit 15 may detect the state of attachment/detachment based on the presence/absence of contact by the electrical terminal. For example, a connector portion that can be connected to the connector portion of the operation terminal 7 may be provided inside the attachment port 25. In this case, it is determined that the operation terminal 7 is mounted on the attachment port 25 when the connector portions are connected to each other. In this case, data may be exchanged between the apparatus main body 1 and the operation terminal 7 via connection by the connector portions. Further, when the connector portions are connected to each other, the operation terminal 7 may be configured to receive power supply from the apparatus main body 1.

Further, the unit that detects the state of attachment/detachment of the operation terminal 7 is not limited to a unit that is provided in the apparatus main body 1. For example, when a gyro sensor or the like is provided inside the operation terminal 7, whether the operation terminal 7 is mounted on the attachment port 25 may be determined by the posture such as the inclination of the operation terminal 7 detected by the gyro sensor or the like. In this case, for example, when the operation terminal 7 shows a posture in an upright state, it is determined that the operation terminal 7 is mounted on the attachment port 25.

In the embodiment, the case is described where the information on the dominant hand of the practitioner P of the practitioner information is input when the practitioner as a person having the nail T on which printing is performed or another person different from the person operates the operation unit 71, and the control unit 81 as the information acquisition unit acquires this information. However, the configuration in which the control unit 81 acquires the information on the dominant hand of the practitioner P is not limited to this.

For example, a space for disposing tools such as a liquid agent bottle used for performing the treatment of applying the base and a brush for applying the liquid agent may be provided on both the left and right sides of the apparatus main body 1 and the like, and a detection unit may be provided that detects whether the practitioner P has moved (taken) the left or right side tool from the placement location.

In this case, for example, when it is detected that the practitioner P has taken the bottle placed on the right, it is determined that the dominant hand Dh of the practitioner P is the right hand, and when it is detects that the practitioner P has taken the bottle placed on the left, it is determined that the dominant hand Dh of the practitioner P is the left hand. The control unit 81 may acquire the information on the dominant hand in this manner.

With such a configuration, it is possible to reduce the burden by eliminating trouble of inputting the information on the dominant hand by the user or the like.

Further, in the present embodiment, as the print head 41 of the apparatus main body 1, the inkjet type print head 41 is provided, but the configuration of the print head 41 is not limited to this.

A configuration of a syringe-type head, a pen-type head, or the like, which is different from the inkjet type print head 41, may be provided.

Moreover, in the embodiment, an example is shown in which the apparatus main body 1 performs printing on the nail in cooperation with the operation terminal 7, but the apparatus main body 1 is not limited to the one shown here. The configuration may be such that the apparatus main body 1 completes the printing operation.

For example, in the embodiment, an example is shown in which an input of a print start instruction and a selection of a nail design (design) are performed by the operation unit 71 of the operation terminal 7, but the configuration may be such that the inputs of various instructions, and the like are performed by the operation unit 12 of the apparatus main body 1. In this case, the apparatus main body 1 may be provided with a touch panel type operation unit. Further, the apparatus main body 1 may be provided with a display unit, and in this case, the display unit may be integrally provided with a touch panel.

Moreover, in the embodiment, an example is shown in which the nail design storage area 822 that stores nail design (design) data is provided in the storage unit 82 of the operation terminal 7, but the nail design data is not limited to be stored in the storage unit 82 of the operation terminal 7. It may be stored in the storage unit 32 of the apparatus main body 1.

Further, the configuration may be such that the image data of the nail design is stored in a server device or the like that can be connected via a network line or the like, and the server device or the like may be accessed so that the nail design data can be referred to.

By doing so, it is possible to select a design to be printed from a larger number of nail designs without increasing the capacity of the storage unit 82 or the like.

In the embodiment, the configuration in which the nail information detection unit 813 and the print data generation unit 814 are provided in the operation terminal 7, and the control device 80 of the operation terminal 7 detects the nail information from the nail image and generates the print data is exemplified, but the configuration of the printing apparatus 100 is not limited to this.

For example, the control device 30 of the apparatus main body 1 may include a nail information detection unit, a print data generation unit, and the like, and the control device 30 may detect the print region (nail contour of the nail T, and the like) from the nail image and may generate print data to perform printing in the print region (for example, the inner region of the nail contour).

In this case, a program corresponding to the storage unit 32 or the like of the apparatus main body 1 is incorporated.

Although some embodiments of the present disclosure have been described above, the scope of the present disclosure is not limited to the above-described embodiments, but includes the scope of the disclosure described in the claims and the equivalent scope thereof.

What is claimed is:

1. A printing apparatus comprising:

a processor; and a print head, wherein the processor is configured to:

determine a base application order in which a base was applied to nails of a plurality of fingers by a practitioner based on practitioner information about the practitioner who applied the base to the nails, the practitioner information including information on a dominant hand of the practitioner; and set, based on the determined base application order, a print order for performing printing on the nails of the plurality of fingers, and wherein the print head is configured to perform, based on the print order, printing on the nails of the plurality of fingers, to which the base was applied.

2. The printing apparatus according to claim 1, wherein the processor is configured to determine the base application order based on the information on the dominant hand.

3. The printing apparatus according to claim 1, wherein the practitioner information further includes treatment subject information about whether the practitioner is a person having a nail on which printing is to be performed or another person different from the person, and wherein the processor is configured to determine the base application order based on the treatment subject information.

4. The printing apparatus according to claim 1, wherein the processor is configured to set the print order so that printing is performed on the nails starting from a nail of a finger determined to be an earlier finger in the base application order.

5. The printing apparatus according to claim 1, further comprising:

a memory that pre-stores designs for printing on the nails of the plurality of fingers in association with finger types, wherein the print head sequentially prints the pre-stored designs based on the print order set by the processor.

6. The printing apparatus according to claim 1, further comprising:

an operation unit that is configured to be removable from an apparatus main body, wherein the practitioner information further includes information on an attachment state of the operation unit with respect to the apparatus main body.

7. The printing apparatus according to claim 6, wherein:

the practitioner information further includes treatment subject information about whether the practitioner is a person having a nail on which printing is to be performed or another person different from the person, the treatment subject information indicates that the practitioner is the person having the nail on which printing is to be performed in a state in which the information on the attachment state indicates that the operation unit is attached to the apparatus main body, and the treatment subject information indicates that the practitioner is the another person in a state in which the information on the attachment state indicates that the operation unit is detached from the apparatus main body.

8. A printing system comprising:

a printing apparatus configured to perform printing on a nail; and a terminal device configured to be communicable with the printing apparatus, wherein the system is configured to:

determine a base application order in which a base was applied to nails of a plurality of fingers by a practitioner based on practitioner information about the practitioner who applied the base to the nails, the practitioner information including information on a dominant hand of the practitioner;

set, based on the determined base application order, a print order for performing printing on the nails of the plurality of fingers, and perform, by the printing apparatus based on the print order, printing on the nails of the plurality of fingers, to which the base was applied.

9. A printing method, performed by at least one processor, using a printing apparatus configured to perform printing on a nail, the method comprising:

determining a base application order in which a base was applied to nails of a plurality of fingers by a practitioner based on practitioner information about the practitioner who applied the base to the nails, the practitioner information including information on a dominant hand of the practitioner;

setting, based on the determined base application order, a print order for performing printing on the nails of the plurality of fingers; and performing, by the printing apparatus based on the print order, printing on the nails of the plurality of fingers, to which the base was applied.

10. The printing method according to claim 9, wherein the base application order is determined based on the information on the dominant hand.

11. The printing method according to claim 9, wherein the practitioner information further includes treatment subject information about whether the practitioner is a person having a nail on which printing is to be performed or another person different from the person, and wherein the base application order is determined based on the treatment subject information.

12. The printing method according to claim 9, wherein the print order is set so that printing is performed on the nails starting from a nail of a finger determined to be an earlier finger in the base application order.

13. The printing method according to claim 9, further comprising:

pre-storing designs for printing on the nails of the plurality of fingers in association with finger types; and sequentially printing the pre-stored designs based on the print order.

14. The printing method according to claim 9, wherein:

an operation unit is configured to be removable from an apparatus main body, and the practitioner information further includes information on an attachment state of the operation unit with respect to the apparatus main body.

15. The printing method according to claim 14, wherein:

the practitioner information further includes treatment subject information about whether the practitioner is a person having a nail on which printing is to be performed or another person different from the person, the treatment subject information indicates that the practitioner is the person having the nail on which printing is to be performed in a state in which the information on the attachment state indicates that the operation unit is attached to the apparatus main body, and the treatment subject information indicates that the practitioner is the another person in a state in which the information on the attachment state indicates that the operation unit is detached from the apparatus main body.

16. A non-transitory computer-readable recording medium having a program stored thereon which, when executed on at least one processor in a computer of a printing apparatus configured to perform printing on a nail, causes the computer to control processes comprising:

determining a base application order in which a base was applied to nails of a plurality of fingers by a practitioner based on practitioner information about the practitioner who applied the base to the nails, the practitioner information including information on a dominant hand of the practitioner;

setting, based on the determined base application order, a print order for performing printing on the nails of the plurality of fingers; and performing, based on the print order, printing on the nails of the plurality of fingers, to which the base was applied.

* * * * *